United States Patent [19]

Györik

[11] 4,207,797

[45] Jun. 17, 1980

[54] MAGAZINE FOR AN AUTOMATIC WEAPON

[76] Inventor: Joseph J. Györik, 3043 15th St., N.W., Washington, D.C. 20009

[21] Appl. No.: 41,471

[22] Filed: May 22, 1979

[51] Int. Cl.[2] ..... F41C 25/06

[52] U.S. Cl. ..... 89/34; 42/6

[58] Field of Search ..... 42/6, 17, 24, 33, 35, 42/37, 39, 49 R; 89/33 D, 33 B, 33 BA, 34

[56] References Cited

U.S. PATENT DOCUMENTS

| | | | |
|---|---|---|---|
| 162,582 | 4/1875 | Shinn | 42/21 |
| 473,370 | 4/1892 | Thorp | 42/17 |

FOREIGN PATENT DOCUMENTS

| | | | |
|---|---|---|---|
| 6994 | of 1888 | United Kingdom | 42/6 |

*Primary Examiner*—Stephen C. Bentley
*Attorney, Agent, or Firm*—Spencer & Kaye

[57] ABSTRACT

A magazine for an automatic weapon has a plurality of storage chambers arranged in a circular array about a longitudinal magazine axis and extending parallel thereto. Each storage chamber is adapted to receive cartridges in an end-to-end contacting series. The magazine further has a loading arrangement for providing access to the storage chambers at a rear end of the magazine; separate follower springs arranged to extend into each storage chamber for urging the cartridges therein towards a front end of the magazine; a feeding gate arranged at the front end of the magazine; and a feeding arrangement for advancing the cartridges from the storage chambers to the feeding gate. The feeding arrangement has a feeding wheel which is mounted at the front end of the magazine for rotation about the magazine axis and which is divided into feeding chambers, each repeatedly communicating with each storage chamber upon rotation of the feeding wheel for receiving a cartridge therefrom. The feeding gate successively communicates with the feeding chambers as the feeding wheel rotates for sequentially receiving cartridges therefrom. A manually windable power spring is connected with the feeding wheel for exerting a torque thereon.

7 Claims, 8 Drawing Figures

FIG. 4
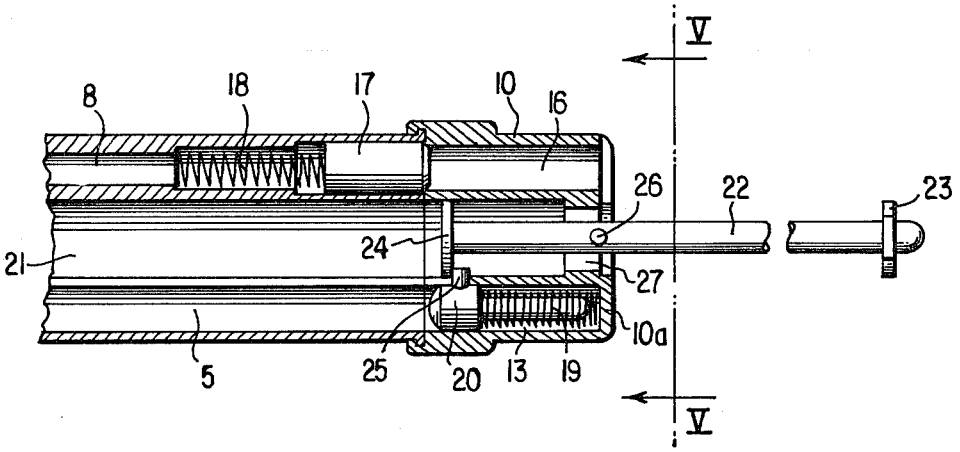
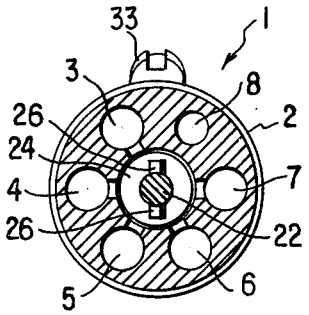
FIG. 3
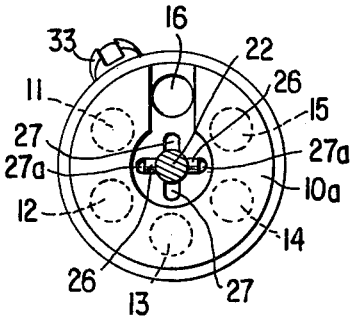
FIG. 5
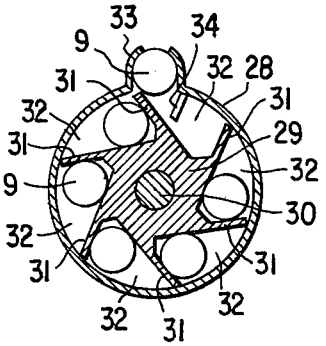
FIG. 7
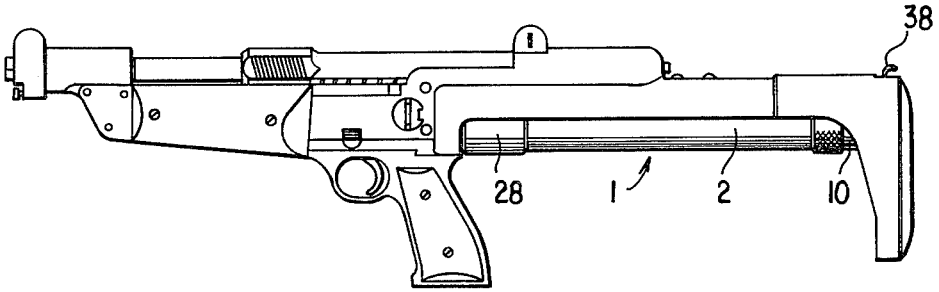
FIG. 8

MAGAZINE FOR AN AUTOMATIC WEAPON

BACKGROUND OF THE INVENTION

This invention relates to a magazine for an automatic weapon, particularly a small weapon, such as a submachine gun.

Generally, the magazines may be of the drum type or the box type. It is generally a disadvantage of drum-type magazines that they are bulky, they are difficult to load and they generally cannot be attached or detached with ease. Further, firing from a lying position is uncomfortable due to the particular location of the drum magazine on the weapon. More recently, the box-type magazines have been more frequently used. In this type of magazine the firing comfort has been improved with the lateral arrangement of the magazine. This, however, is disadvantageous because of the significant additional dimension taken up by the weapon. In the known Hill submachine gun, the length dimension of the box-type magazine is parallel to the barrel and the magazine, which is disposable, is arranged above the bolt.

The invention more particularly relates to a box-type magazine whose longitudinal axis is parallel to the barrel.

It is a further general disadvantage of known magazines for automatic weapons that the cartridges are arranged in the magazine in a single series so that a malfunctioning or jamming within the magazine is likely to interrupt altogether the feed of cartridges to the feeding gate of the magazine, thus preventing the weapon from firing.

SUMMARY OF THE INVENTION

It is an object of the invention to provide an improved box-type magazine for an automatic weapon such as a submachine gun which is of improved reliability, which permits a comfortable firing from a lying position or from cover, which in no way hinders motion through difficult terrain, such as bushy areas, and which has an increased capacity without a corresponding increase in dimensions.

These objects and others to become apparent as the specification progresses, are accomplished by the invention, according to which, briefly stated, the magazine for an automatic weapon has a plurality of storage chambers arranged in a circular array about a longitudinal magazine axis and extending parallel thereto; each storage chamber is adapted to receive cartridges in an end-to-end contacting series. The magazine further has a loading mechanism for providing access to the storage chambers at the rear end of the magazine; separate follower springs arranged to extend into each storage chamber for urging the cartridges therein towards the front end of the magazine; a feeding gate arranged at the front end of the magazine; and a feeding mechanism for advancing the cartridges from the storage chambers to the feeding gate. The feeding mechanism includes a feeding wheel mounted at the front end of the magazine for rotation about the magazine axis with respect to the storage chambers. The feeding wheel is divided into feeding chambers, each repeatedly communicating with each storage chamber upon rotation of the feeding wheel for receiving a cartridge therefrom. The feeding gate successively communicates with the feeding chambers upon rotation of the feeding wheel for sequentially receiving cartridges therefrom. The feeding mechanism further has a feeding spring connected with the feeding wheel for exerting a torque thereon and an arrangement for winding the feeding spring.

It is an advantage of the magazine according to the invention that, by virtue of the arrangement of the cartridges in independent series, a malfunctioning or breakdown in one series will not necessarily mean the interruption of the firing of the weapon.

It is a further advantage of the magazine according to the invention that it is adapted for insertion into a position in which it is at least approximately parallel to the barrel and is situated underneath the bolt of the weapon.

BRIEF DESCRIPTION OF THE DRAWINGS

FIG. 3 is a sectional view taken along line III—III of FIG. 1.

FIG. 4 is an axial sectional view of a detail of the structure shown in FIG. 2 depicting the components in a different operational position.

FIG. 5 is an end view as seen in the direction of arrows V—V of FIG. 4.

FIG. 7 is a sectional view taken along line VII—VII of FIG. 1.

FIG. 8 is a schematic view of a submachine gun incorporating the invention.

DESCRIPTION OF THE PREFERRED EMBODIMENT

Figure 1:
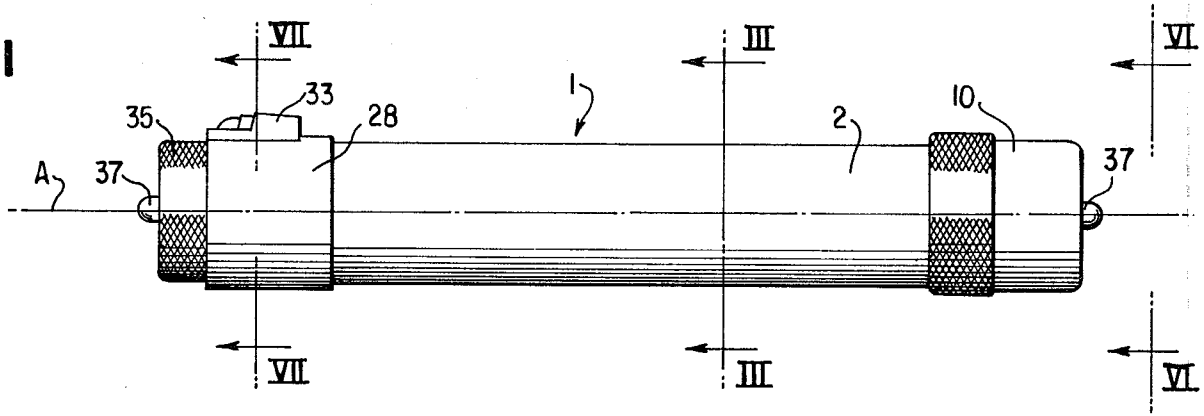
FIG. 1 is a side elevational view of a preferred embodiment of the invention.
Figure 2:
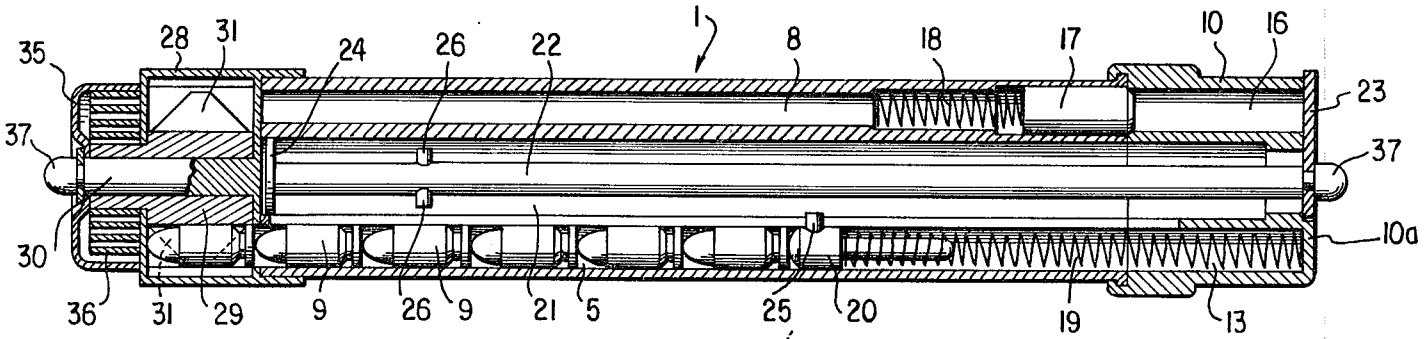
FIG. 2 is an axial sectional view of the preferred embodiment taken along line II—II of FIG. 6.

Turning now to FIGS. 1, 2 and 3, the magazine generally indicated at 1 has a cylindrical body 2 which has a longitudinal axis A. Within the body 2 there are provided a plurality of axially parallel channels which are arranged in an even circumferential distribution about the axis A. In the illustrated example there are shown six channels 3–8, respectively. The channels 3, 4, 5, 6 and 7 constitute storage chambers in which cartridges 9 are received in an end-to-end relationship. The channel 8 accommodates a spring-loaded positioning device to be described later. It is noted that in practice the number of the storage chambers may be nine, each having a capacity of nine cartridges.

Figure 6:
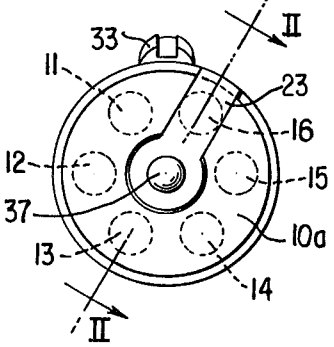
FIG. 6 is an end view as seen in the direction of arrows VI—VI of FIG. 1.

Also referring to FIGS. 4, 5 and 6, at the rear end of the cylindrical body 2, there is, coaxially with the axis A, rotationally mounted a loading head 10. Within the loading head 10 there are provided five spring chambers 11–15 and a cylindrical loading port 16. The spring chambers 11–15 are closed at one end by the radial rear terminal wall **10*a* of the loading head 10, while the loading port 16 is open at both ends. The spring chambers 11–15 and the loading port 16 are, when viewed together, so arranged radially with respect to the axis A and have such an angular circumferential distribution that upon rotation of the loading head 10, the components 11–16 are brought into respective alignment with the channels 3–8 arranged in the cylindrical body 2. To provide for a positive successive alignment of these components, a positioning device of the "click-type" is accommodated in the channel 8 of the body 2. The positioning device comprises a positioning plug 17 urged outwardly from the body 2 in the direction of the loading head 10 by means of a positioning spring 18. The external terminus of the positioning plug 17 is received in the open end of that one of the respective components 11–16 which is momentarily in alignment with the positioning device 17, 18. In this manner the loading head 10 is immobilized in a position in which with each component 3–8 in the body 2 there is in alignment a component 11–16 provided in the loading head 10. The immobilizing force of the positioning spring 18 can be overcome upon exerting a manual torque on the loading head 10** to rotate it into a subsequent aligned position as will be discussed in greater detail later.

Each spring chamber 11–15 carries a follower coil spring 19 which engages, at one end, the inner face of the rear wall 10*a* of the loading head 10. At its other end, each follower spring 19 carries a follower plunger 20, which is adapted to engage the outermost cartridge in the respective aligned storage chambers 3–7, thus exerting a forwardly urging force on each series of cartridges situated in the respective storage chambers 3–7. The follower springs 18 are so designed that in the fully compressed state they are, together with the entire length of the respective follower plunger 20, fully received in the respective spring chamber 11–15 as will be described later.

The tubular body 2 further has a central axial space 21 in which there is longitudinally displaceably and rotatably supported an arming rod 22. During normal operation of the magazine, the arming rod 22 is in its position as illustrated in FIG. 2.

To the arming rod 22, at the rear terminus thereof as viewed in FIG. 2, there is secured a radially oriented, manually engageable arming lever 23 which in its normal position, as shown in FIGS. 2 and 6, closes off the loading port 16 from the outside.

To the front terminus of the arming rod 22 there is secured an arming disc 24 which, when the arming rod 22 is manually displaced towards its pulled-out position as shown in FIG. 4, it carries with it all the follower plungers 20 by virtue of engagement with respective lugs 25 attached to each follower plunger 20 and projecting into the central space 21. Detent pins 26 are secured to the arming rod 22 at a distance from the arming disc 24. The detent pins 26, as the arming rod 22 is pulled against the force of the follower springs 19, pass through slots 27 provided in the rear wall 10*a* of the loading head 10 and thereafter upon rotating the arming rod 22 about 90°, the detent pins 26 are brought out of alignment with the slots 27 and into alignment with the depressions 27*a* provided in the wall 10*a* of the loading head 10. Then, after releasing the pull-back lever 23, the springs 19, via the lugs 25 and the arming disc 24, urge the detent pins 26 into the depressions 27*a*. In this manner the arming rod 22 can be immobilized in its pulled-out position as shown in FIGS. 4 and 5.

Turning now in particular to FIGS. 1, 2 and 7, to the front end of the tubular body 2 there is affixed a feed housing 28 in coaxial relationship with respect to the axis A. Withing the feed housing 28 there is accommodated a feeding wheel 29 which is rotatably supported on a shaft 30 secured to the tubular body 2 in coaxial relationship with the axis A. The feeding wheel 29 has six radially extending uniformly distributed feeding vanes 31; each two adjoining feeding vanes 31 define, between themselves, a feeding chamber 32 which at its outside, is bounded by a wall portion of the feed housing 28. The feed housing 28 has an aperture through which a cartridge may pass from the feeding chambers into a feeding gate 33 of conventional structure. Each feeding vane 31 has a radially outwardly tapering configuration as illustrated in FIG. 2 for clearing two pickup blades 34 (only one shown in FIG. 7) attached to the inner wall of the feed housing 28 in the vicinity of the feeding gate 33, on either side of the vanes 31. The purpose of the pickup blades 34 is to guide the cartridge into the feeding gate 33 from the respective feeding chamber 32 as the latter moves past the feeding gate 33.

On the shaft 30 there is further rotatably mounted a feeding spring drum 35 in which there is arranged a power spring 36. At its inner end, the power spring 36 is affixed to a hub portion of the feeding wheel 29, whereas its outer end is secured to an inner wall of the feeding spring drum 35.

When the feeding wheel 29 is blocked in its rotation by a cartridge dwelling in the feeding gate 33 as will be described later, a manual rotation of the feeding spring drum 35 will cause winding of the power spring 36 as a result of the relative rotation between the feeding spring drum 35 and the feeding wheel 29. A one-way brake assembly (not shown) cooperating with the feeding spring drum 35 and the feeding wheel 29 ensures that the feeding spring drum 35 can be rotated only unidirectionally in the sense of winding the power spring 36. Thus, when the feeding wheel 29 is blocked and the feeding spring drum 35 has been rotated through a predetermined number of turns and then released, the feeding spring 36 exerts a torque on the feeding wheel 29. It is thus seen that as long as there is no cartridge in the feeding gate 33, the feeding wheel 29 is free to rotate under the force of the power spring 36.

FIG. 8 shows the magazine 1 in place in the automatic weapon, such as a submachine gun. As seen, the longitudinal magazine axis is generally parallel to the barrel of the weapon and the magazine is situated below the barrel and between the grip and the butt plate. The magazine 1 has at both ends axially projecting holding pins 37 (as seen in FIGS. 1 and 2) which cooperate with respective holes or depressions in the weapon to hold the magazine 1 in place. One of the depressions may be provided in a manually engageable leaf-spring member 38 which, when pushed rearwardly, releases the magazine 1 from the weapon.

In the description which follows, the operation of the above-described magazine will be set forth.

The operation of the magazine may be divided into a loading phase in which the magazine is charged with the cartridges and an emptying phase during which the cartridges are fed into the firing weapon.

For loading the magazine, the latter is lifted out of the weapon and, as the first step, a cartridge is manually placed from the outside directly into the feeding gate 33 for thus preventing rotation of the feeding wheel 29 as may be observed in FIG. 7. Then, the power spring 36 is wound by turning the feeding spring drum 35 through several turns and then releasing the same. In this position the assembly formed of the feeding spring drum 35, the power spring 36 and the feeding wheel 29 is immobilized and a torque is exerted on the feeding wheel 29 by the power spring 36, whereby a feeding vane 31 abuts the cartridge positioned in the gate 33.

Next, the arming lever 23 of the arming rod 22 is manually grasped and the arming rod 22 is pulled out. During its motion towards the right (as viewed in FIG. 2), the arming disc 24, by virtue of the lugs 25 entrains the follower plungers 20, causing a compression of the follower springs 19. In the final phase of the outward pull of the arming rod 22, as the detent pins 26 have passed the respective slots 27, all the follower springs 19, together with their associated follower plungers 20, have been pulled back in their entirety into the respective spring chambers 11–15 of the loading head 10. In this position of the follower springs 19, the loading head 10 is free to be rotated with respect to the tubular body 2. As it has been described earlier in connection with FIG. 4, the arming rod 22 is immobilized in the armed state of the follower springs 19 by bringing the detent pins 26, by means of a 90° turn of the arming rod 22, out of alignment with the slots 27 and allowing the detent pins 26 to rest in the depressions 27*a* of the loading head wall 10*a*. Since now the arming lever 23 is removed from the loading head 10, the loading port 16 of the loading head 10 is accessible from the outside. The loading port 16 in the loading head 10 is brought into alignment with a first one of the storage chambers 3–7 (by a manual rotation of the loading head 10) whereupon the cartridges are fed consecutively into the storage chamber in an orientation as shown in FIG. 2. The leading cartridge assumes its final position in the respective aligned feeding chamber 32 of the feeding wheel 29. After the first storage chamber is filled, the loading head 10 is rotated until, as indicated by the "click" of the positioning device 17, 18, the loading port 16 is brought into alignment with the following storage chamber. This loading operation is continued until all five storage chambers 3–7 are charged with cartridges.

Thereafter, the arming rod 22 is manually slightly pulled back and rotated to bring the detent pins 26 into alignment with the slots 27 and then the arming rod 22 is shifted from its pulled position shown in FIG. 4 into its normal position shown in FIG. 2. The loading phase is now completed: all the storage chambers 3–7 are filled with cartridges which are urged towards the front end of the magazine by the respective follower springs 19 and further, a torque is exerted on the feeding wheel 29 which, however, is prevented from rotating due to the presence of a cartridge in the feeding gate 33.

Subsequently, the loaded magazine 1 is placed into the weapon and thus it assumes a position as illustrated in FIG. 8.

Turning now to the emptying phase, as the weapon is fired, the bolt (not shown) of the weapon moves forward and in a conventional manner pushes the cartridge in a forward direction out of the feeding gate 33 in the axial direction into the barrel of the weapon.

Referring now in particular to FIG. 7, as the cartridge 9 has left the feeding gate 33, the feeding wheel 29 is free to rotate and, as a result, a subsequent feeding chamber 32 of the feeding wheel 29 is brought immediately underneath the feeding gate 33. During this motion the trailing vane 31 bounding the last-named feeding chamber 32 displaces, with the cooperation of the pickup blades 34, the cartridge upwardly into position within the feeding gate 33. Thus, in this manner, a new cartridge is ready for removal from the feeding gate 33 by the bolt of the weapon for firing the next shot. Thus, as illustrated in FIG. 7, at the moment the feeding wheel 29 assumes its new position, one of the feeding chambers 32, namely the chamber which previously was underneath the feeding gate 33, is empty. This empty chamber 32 in the position shown in FIG. 7, is now in alignment with the channel 8 which is not a storage chamber, but which, at its right-hand end, accommodates the positioning device 17, 18 as described before. Apart from the round advanced into the feeding gate 33, each cartridge originally positioned in its respective feeding chamber 32 has been rotated one feeding chamber division closer to the feeding gate 33. It is thus seen that as the feeding wheel 29 comes to a rest after the first cartridge has been advanced by the feeding wheel 29 into the feeding gate 33, no refill of any of the feeding chambers 32 from the storage chambers 3–7 has yet taken place.

As the second cartridge is removed by the bolt from the feeding gate 33, the feeding wheel 29 rotates again, advancing a new cartridge into the feeding gate 33. At the same time, the first empty feeding chamber 32 arrives into alignment with the storage chamber 7. Thus, the leading cartridge in the storage chamber 7 is advanced, by the follower spring 19, into the empty feeding chamber 32. Since the other four feeding chambers 32 are still loaded, no charging from the other storage chambers 3–6 takes place at this time.

The above-described stepwise operation, that is, the refilling of an empty feeding chamber from the storage chamber 7 takes place until the storage chamber 7 is emptied and the lug 25 of the follower plunger 20 is pressed by the follower spring 19 against the arming disc 24. In this manner the follower plunger 20 is prevented from being advanced by the follower spring 19 into the momentarily aligned feeding chamber 32. Since thereafter the empty feeding chamber is no longer replenished from the storage chamber 7, it arrives in an empty state into alignment with the next storage chamber 6. Thus, now the loading of the feeding chambers 32 occurs solely from the storage chamber 6 until the storage chamber 6 has expended the last cartridge.

In the above-described manner, all the storage chambers 7–3 which remain stationary during operation are consecutively emptied.

Should in any of the storage chambers 3–7 jamming occur, the charging of the feeding chambers 32 may continue from the other storage chambers and thus the jamming or other malfunction in one storage chamber does not halt the operation of the magazine, as long as at least one other loaded storage chamber is still present.

The magazine will be empty as the last cartridge—which was the last in the series accommodated in the storage chamber 3—is removed from the feeding gate 33 by the bolt of the weapon.

It is to be understood that the above description of the preferred embodiments is susceptible to modifications, changes and adaptations, and the same are intended to be comprehended within the meaning and range of equivalents of the appended claims.

What is claimed is:

1. A magazine for an automatic weapon comprising in combination:

(a) means defining a plurality of stationary storage chambers arranged in a circular array about a longitudinal magazine axis and extending parallel thereto; each said storage chamber being adapted to receive cartridges in an end-to-end contacting series;

(b) loading means for providing access to said storage chambers at a rear end of the magazine;

(c) separate follower springs arranged to extend into each storage chamber for urging the cartridges therein towards a front end of the magazine;

(d) a feeding gate arranged at said front end of the magazine; and (e) feeding means for advancing the cartridges from said storage chambers to said feeding gate; said feeding means including (1) a feeding wheel mounted at said front end of the magazine for rotation about said axis with respect to said storage chambers; said feeding wheel being divided into feeding chambers, each repeatedly communicating with each said storage chamber upon rotation of said feeding wheel for receiving a cartridge therefrom; said feeding gate being arranged to successively communicate with said feeding chambers upon rotation of said feeding wheel for sequentially receiving cartridges therefrom;

(2) a power spring connected with said feeding wheel for exerting a torque thereon; and (3) means for manually winding said power spring.

2. A magazine as defined in claim 1, wherein the number of said feeding chambers is greater by one than the number of said storage chambers.

3. A magazine as defined in claim 2, wherein said loading means comprises a loading head mounted at said rear end of the magazine for rotation about said axis with respect to said storage chambers; said loading head including a plurality of spring chambers and a loading port arranged in a circular array about said axis; the number of said spring chambers equalling the number of said storage chambers; each said spring chamber receiving a separate one of said follower springs; further comprising a manually engageable arming means movable into an arming position for compressing simultaneously all said follower springs fully into the respective spring chambers for permitting manual rotation of said loading head with respect to said storage chambers to bring said loading port consecutively into alignment with said storage chambers for introducing cartridges thereinto through said loading port.

4. A magazine as defined in claim 3, wherein said arming means comprises an arming rod arranged sustantially in alignment with said axis; spring-engaging means secured to said arming rod for at least indirectly engaging said follower springs; said arming rod having a normal position in which it is substantially in its entirety within the confines of the magazine and a pulled-out position in which a substantial part thereof projects beyond said loading head externally of the magazine; said pulled-out position constituting said arming position; and means for maintaining said arming lever in said pulled-out position while cartridges are introduced into said storage chambers through said loading port.

5. A magazine as defined in claim 4, wherein said arming means further comprises an arming lever attached to said arming rod and situated externally of said loading head; said arming lever being in engagement with said loading head and covering said loading port when said arming rod is in its said normal position; said arming lever being spaced from said loading head and uncovering said loading port when said arming rod is in its pulled-out position.

6. A magazine as defined in claim 4, further comprising follower plungers, one mounted at an end of each said follower spring for engaging the trailing cartridge in the end-to-end contacting series in the respective storage chamber and further wherein said spring-engaging means comprises an arming disc attached to said arming rod and arranged for abutting a portion of each said follower plunger for moving said follower plungers with said arming disc when said arming rod is moved from said normal position into said pulled-out position.

7. A magazine as defined in claim 6, wherein said portion of each said follower plunger comprises a lug projecting into the traveling path of said arming disc.

* * * * *